United States Patent [19]

Wardle et al.

[11] Patent Number: 4,931,112

[45] Date of Patent: Jun. 5, 1990

[54] GAS GENERATING COMPOSITIONS CONTAINING NITROTRIAZALONE

[75] Inventors: Robert B. Wardle, Logan; Jerald C. Hinshaw, Ogden; Robert M. Hajik, Willard, all of Utah

[73] Assignee: Morton International, Inc., Chicago, Ill.

[21] Appl. No.: 439,464

[22] Filed: Nov. 20, 1989

[51] Int. Cl.[5] ..... C06B 25/00

[52] U.S. Cl. ..... 149/88; 149/62; 149/109.6; 280/736; 280/741

[58] Field of Search ..... 149/62, 88, 109.6; 280/736, 741

[56] References Cited

U.S. PATENT DOCUMENTS 4,733,610 3/1988 Lee et al. ..... 149/109.6

OTHER PUBLICATIONS

London et al., *A Toxicological Study of NTO,* La-1053-3-MS, UC-48, Sep. 1985.

*Anonymous, a New Explosive Molecule ONTA "Oxynitrotiazole"*, 18 Feb. 1986.

Becuwe et al., "NTO and its Utilization as an Insensitive Explosive", *Technology of Energetic Materials,* 18th International Annual Conference of ICT 1987, Jul. 1-3, 1987.

Collignon, *NTO Process Development,* 28-30 1987.

Chan et al., *Insensitive Explosives.*

Patent Application, U.S. Ser. No. 07/347,540, filed May 4, 1989, *Gas Generant Compositions Containing Salts of 5-Nitrobarbituric Acid, Salts of Nitroorotic Acid, or 5-Nitrouracil.*

*Primary Examiner*—Stephen J. Lechert, Jr.

*Attorney, Agent, or Firm*—Gerald K. White

[57] ABSTRACT

Automotive airbag gas generant formulation providing an alternative to commercially used formulations containing sodium azide. The composition contains from about 25% to about 75% by weight of 5-nitro-1,2,4-trizal-3-one (usually known as nitrotriazolone). The other principal ingredient of the composition is from about 25% to about 75% by weight of an anhydrous oxidizing salt having a cation selected from metals of Group I-A of the Periodic Table (except sodium), calcium, strontium, or barium, and an anion which is essentially free of carbon, hydrogen, or halogens. From about 0.1% to about 5% of a binder can be added, if necessary. An automotive airbag inflator containing the composition and a method for generating gas comprising the step of igniting the composition stated above are also disclosed.

11 Claims, No Drawings

GAS GENERATING COMPOSITIONS CONTAINING NITROTRIAZALONE

Nitrotriazalone, or more precisely 5-nitro-1,2,4-triazal-3-one (abbreviated "NTO") is a known compound which has previously been used in explosive compositions. Becuwe, "NTO And Its Utilization As An Insensitive Explosive," *Technology Of Energetic Materials Manufacturing And Processing—Valuation Of Product Properties* (18th International Annual Conference of ICT, 1987). It is not known whether Becuwe is a printed publication. Becuwe shows NTO formulated with HMX—another high explosive—in a composition containing a polyurethane binder.

Several other references having some pertinence are as follows:

| U.S. Pat. No. | Inventor | Issue Date |
|---|---|---|
| 3,839,105 | DeWitt, et al. | 10/01/74 |
| 3,923,804 | Sitzman, et al. | 12/02/75 |
| 4,148,674 | Kehren, et al. | 04/10/79 |
| 4,369,079 | Shaw | 01/18/83 |
| 4,370,181 | Lundstrom, et al. | 01/25/83 |
| 4,360,394 | Portnoy | 11/23/82 |

Of these references, the Sitzman, et al., Kehren, et al., Shaw, Lundstrom, et al., and Portnoy patents show heterocyclic compounds containing carbon and nitrogen as ring elements and relatively little hydrogen.

SUMMARY OF THE INVENTION

Several alternative objects of the invention are as follows. A first object is an azide-free gas generant which burns at a low temperature (about 1400°–1500° K.), burns reliably and reasonably rapidly, does not detonate, and generates non-toxic gases and a minimum of water vapor. A second object is to provide solid combustion products in the form of a clinker which has a melting point near or above the flame temperature, thereby keeping it non-mobile.

A first aspect of the invention is a composition comprising from about 25% to about 75% by weight, preferably from about 35% to about 65% by weight, more preferably from 40–60% by weight, most preferably about 60% by weight NTO. The balance of the composition consists essentially of an anhydrous oxidizing salt. NTO has the following structure:

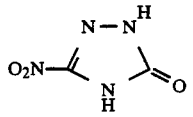

The anhydrous oxidizing salt has a cation selected from metals from Group I-A of the Periodic Table (except sodium) or from the following Group II-A metals: calcium, strontium, or barium. The anhydrous oxidizing salt has an anion which contains oxygen or nitrogen, and which is essentially free of carbon, hydrogen, or halogens. The composition may optionally contain from about 0.1% to about 5% by weight of a binder.

A second aspect of the invention is an automotive airbag inflator. The inflator comprises a metal housing having a gas outlet, a gas generant according to the composition described above within the housing, and a gas filtering system to pass the gaseous combustion products and capture the liquid or solid combustion products of the composition.

A third aspect of the invention is a method for generating gas, comprising the step of igniting the composition of claim 1.

DETAILED DESCRIPTION OF THE INVENTION

NTO has several structural features which make it a desirable fuel in gas generating compositions for inflating automotive airbags. NTO contains nitrogen in the ring structure to maximize the nitrogen content of the gaseous combustion product. NTO's single nitro substituent, attached to a carbon atom of the ring, desirably increases the burn rate. (More than one nitro group would make the compound too energetic and unstable.) NTO's minimal hydrogen content is desirable because this minimizes the formation of water as a combustion product. Water has a high heat capacity and readily condenses to liquid form after escaping the filtration system as a gas. Water, therefore, can transmit undesirably large amounts of heat to the deployed airbag and to a person touching the airbag.

The second essential ingredient of the gas generants described herein is an anhydrous oxidizing salt. The cation of the salt is selected to provide an anhydrous salt. The oxides of the preferred cations (which form during combustion) react with any water which is present to form a hydroxide, therefore binding any water which is present in the combustion products and preventing the release of water into the airbag as steam. Accordingly, particular cations contemplated herein are metals of Group I-A of the Periodic Table (except sodium), calcium, strontium, or barium. Other cations useful herein can be readily determined.

The anion of the anhydrous oxidizing salt, which typically contributes the oxidizing function, is most broadly characterized as containing nitrogen and oxygen and being essentially free of carbon, hydrogen or halogens. Exemplary anions are nitrate, nitrite, and hexanitrocobaltate—$Co(NO_2)_6^{-3}$. Nitrates and nitrites are preferred because they have a low heat formation, are inexpensive, and are available as anhydrous salts. The two most preferred anhydrous oxidizing salts for use herein are potassium nitrate and strontium nitrate.

Mixture of NTO and oxidizing salts can be pressed into cohesive pellets which sometimes are sufficiently rugged for use in an airbag gas generator without a binder being present. However, it is usually necessary to provide a small proportion of a binder to the composition. One specific binder contemplated herein, which is well-known in this application, is molybdenum disulfide. A second binder useful herein is polypropylene carbonate.

Polypropylene carbonate is a compound having a number average molecular weight of about 50,000 and the following backbone structure:

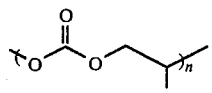

The inventors believe the terminal groups are alkyl groups. A suitable polypropylene carbonate is sold by a joint venture of Air Products and Chemicals, Inc., Emmaus, Pa., ARCO Chemical Co., Philadelphia, Pa., and Mitsui Petrochemical Industries, Ltd., Tokyo, Japan. If potassium salts are present in the composition, molybdenum disulfide is the preferred binder. Polypropylene carbonate is preferred as a binder when strontium salts are used.

Additional ingredients should be minimized, particular inert ingredients which do not contribute to the volume of gas generated by the composition, or which may introduce deleterious combustion products. One exception is heat conducting fibers, such as about 1% graphite fibers or iron fibers, which increase the burning rate of the composition and transfer heat during combustion.

To manufacture the composition, it is slurried at a concentration of about 40 weight percent in water. The slurry is mixed thoroughly, then spray dried to form about two millimeter diameter prills. The prills are fed to pellet forming machinery which presses uniformly weighed portions of the composition, forming discrete pellets.

Another aspect of the invention is an automotive airbag inflator comprising a metal housing having a gas outlet; a particulate gas generating composition according to the previous description disposed within the housing; an igniter disposed within the housing adjacent to the gas generating composition; and a gas filtering system disposed between the composition and the outlet of the metal housing. More specific details and illustrations of one type of inflator contemplated herein are found in U.S. Pat. No. 4,547,342, issued to Adams, et al. on Oct. 15, 1985. That patent is hereby incorporated herein in its entirety by reference.

A final aspect of the invention is a method of generating gas, which comprises the step of igniting the composition of claim 1. If gas is to be delivered under pressure, the composition should be placed in a housing as described in the previous paragraph before being ignited.

EXAMPLE 1

NTO was synthesized as follows. A slurry of 223 grams of semicarbazide hydrochloride and 230 ml. of 88% formic acid was refluxed for four hours in a three-necked, three-liter flask equipped with a stirrer, condenser, and thermometer. This oversized flask was used to contain extensive foaming which occurred during the reaction. All of the solid hydrochloride dissolved after an hour. The reaction mixture was then cooled to 5° C., forming a precipitate which was filtered. The precipitate was washed with two portions of absolute ethanol, precooled to 5° C. The product was dried at 40° C. under vacuum. The dried product was recrystallized from water. The resultant material had a melting point of 229°-233° C.; 65.34 grams of product were recovered. This intermediate product was 3-hydroxy-1,2,4-triazole.

Next, the foregoing material was nitrated to form NTO. 200 ml. of 70% nitric acid were placed in a 500 ml. round-bottom 3-neck flask equipped with a thermometer and stirrer. Then, 50 grams of 3-hydroxy-1,2,4-triazole were slowly added. A slight exotherm occurred during the addition. The hydroxy triazole dissolved in the acid, after which stirring was continued for one hour at room temperature. Then the flask was heated to 50° C. to trigger the reaction, which was held to 55° C. for 30 minutes. The reaction mixture was cooled to 5° C. A precipitate formed and was filtered and washed with cold water (two washes, each using 50 ml. of distilled water). Then the material was washed twice with 100 ml. portions of ether. 31.13 grams of material were recovered; it had a melting point of 264°-266° C. This final product was NTO.

EXAMPLE 2

The ingredients of the table below were mixed as dry materials, slurried in water, and dried under vacuum at 140° F. (60° C.). Cylindrical pellets nominally about one-half inch (1.3 cm.) long and one-half inch (1.3 cm.) in diameter were prepared. The actual length of each pellet is reported in the data. The sides of each pellet were inhibited with a rubber-based adhesive. Each individual pellet was placed in a one-liter bomb and temperature conditioned by placing the bomb in a water bath for 10 minutes at room temperature. The bomb was equipped with a pressure transducer. The contents of the bomb were ignited, and pressure versus time was plotted. Burning time was calculated by determining the interval during which the pressure in the bomb was increasing. Burning rate was determined by dividing the length of each pellet by its burning time. The burn rate in centimeters per second is presented in the table.

TABLE

| Formula | Mix # | NTO (%) | Oxidizer[1] | Burn Rate (cm/sec) |
|---|---|---|---|---|
| A | 137 | 60.6 | 39.4 | 2.870 |
| B | 138 | 38.1 | 61.9 | 1.427 |

[1]Strontium Nitrate.

What is claimed is:

1. A composition consisting essentially of from about 25% to about 75% by weight nitrotriazalone and from about 25% to about 75% by weight of an anhydrous oxidizing salt having a cation selected from metals of group I-A of the Periodic Table (except sodium), calcium, strontium, or barium, said salt having an anion which is essentially free of carbon, hydrogen, and halogens.

2. The composition of claim 1, consisting essentially of from about 35% to about 65% by weight of nitrotriazalone and from 65% to about 35% by weight of said anhydrous oxidizing salt.

3. The composition of claim 1, consisting essentially of from about 40% to about 60% by weight of nitrotriazalone and from about 60% to about 40% by weight of said anhydrous oxidizing salt.

4. The composition of claim 1, consisting essentially of about 60% by weight of nitrotriazalone and about 40% by weight of said anhydrous oxidizing salt.

5. The composition of claim 1, wherein said anion is selected from the group consisting of nitrate, nitrite and hexanitrocobaltate.

6. The composition of claim 1, wherein said anion is nitrate.

7. The composition of claim 1, wherein said anhydrous oxidizing salt is strontium nitrate.

8. The composition of claim 1, wherein said anhydrous oxidizing salt is potassium nitrate.

9. The composition of claim 1, further consisting essentially of from about 0.1% to about 5% of weight of a binder.

10. An automotive airbag inflator comprising: a metal housing having a gas outlet, a particulate gas generating composition according to claim 1 disposed within said housing, an igniter disposed within said housing adjacent to said composition and a gas filtering system disposed between said composition and said outlet.

11. A method for generating gas, comprising the step of igniting the composition of claim 1.

* * * * *